US011345140B2

(12) United States Patent
Flower et al.

(10) Patent No.: US 11,345,140 B2
(45) Date of Patent: May 31, 2022

(54) MANUALLY OPERATED COLLAPSABLE SCREEN PRINTING APPARATUS

(71) Applicants: Brandy Michael Flower, Los Angeles, CA (US); Michael A. Crivello, Los Angeles, CA (US)

(72) Inventors: Brandy Michael Flower, Los Angeles, CA (US); Michael A. Crivello, Los Angeles, CA (US)

( * ) Notice: Subject to any disclaimer, the term of this patent is extended or adjusted under 35 U.S.C. 154(b) by 204 days.

(21) Appl. No.: 16/453,124

(22) Filed: Jun. 26, 2019

(65) Prior Publication Data

US 2020/0406604 A1 Dec. 31, 2020

(51) Int. Cl.
*B41F 15/08* (2006.01)
*B41F 15/02* (2006.01)
*B41F 15/18* (2006.01)

(52) U.S. Cl.
CPC ..... *B41F 15/0863* (2013.01); *B41F 15/02* (2013.01); *B41F 15/18* (2013.01)

(58) Field of Classification Search
None
See application file for complete search history.

(56) References Cited

U.S. PATENT DOCUMENTS 5,018,441 A * 5/1991 Miraglia, Jr. ..... B41F 15/04 101/123
5,154,119 A * 10/1992 Fuqua ..... B41F 15/0863 101/115
5,445,075 A * 8/1995 Panipinto ..... B41F 15/10 101/127.1
5,503,068 A * 4/1996 Newman ..... B41F 15/16 101/126
5,544,581 A * 8/1996 Haji ..... B41F 15/02 101/126
5,845,569 A * 12/1998 Tkacz ..... B41F 15/0863 101/115
5,881,641 A * 3/1999 Tkacz ..... B41F 15/0863 101/115
6,123,023 A * 9/2000 Ono ..... B41L 13/02 101/125
9,370,923 B1 * 6/2016 Mariano ..... H05K 3/1233
9,561,642 B2 * 2/2017 Fuqua ..... B41F 15/36

* cited by examiner

*Primary Examiner* — Jill E Culler

(57) ABSTRACT

A manually-operated collapsible screen printing apparatus is disclosed that is designed to be a lightweight, transportable, and efficiently print any quantity of high quality prints, among other advantages.

16 Claims, 4 Drawing Sheets

MANUALLY OPERATED COLLAPSABLE SCREEN PRINTING APPARATUS

BACKGROUND

Traditional presses can weigh upwards of 140 kilograms and have an operational foot print of roughly 100 feet square and occupy roughly 500 cubic feet of space. In addition, traditional presses that perform similar functions require many tools and man hours to disassemble into manageable parts before it can be transported. Hence, what is needed is a lightweight and transportable screen printing press.

BRIEF SUMMARY

In one aspect of the disclosure described herein, the screen printing apparatus of the disclosure described herein allows two operators to print from either side of the apparatus simultaneously. The apparatus has two retractable platens that can attach to either side of the case body. To meet certain clients demands for output the apparatus is capable of producing 200 high quality prints per hour with both operators printing in tandem. However, only one printing platen needs to be active for the press to function properly. This design feature allows apparatus to effectively and efficiently meet a client's needs, and also allows them to employ an exact number of operators needed to complete the job, helping to make the apparatus efficient and competitive within their own growing industry, among other advantages.

In addition, one of the distinguishing features of the collapsible apparatus is its weight of 22 kilograms and falls under the normal size constraints for passenger airline luggage. The collapsible apparatus occupies 3.9 cubic feet when it is fully closed. These dimensions together allow the apparatus to be checked as standard luggage on any airline. This apparatus is in full compliance with TSA and FAA standard luggage requirements and can be delivered anywhere in the world without incurring extra fees or charges. This FAA and TSA compliance is something no other six arm silk screen apparatus can claim to be compliant with, among other advantages.

The above summary is not intended to describe each and every disclosed embodiment or every implementation of the disclosure. The Description that follows more particularly exemplifies the various illustrative embodiments.

DETAILED DESCRIPTION

Figure 1A:
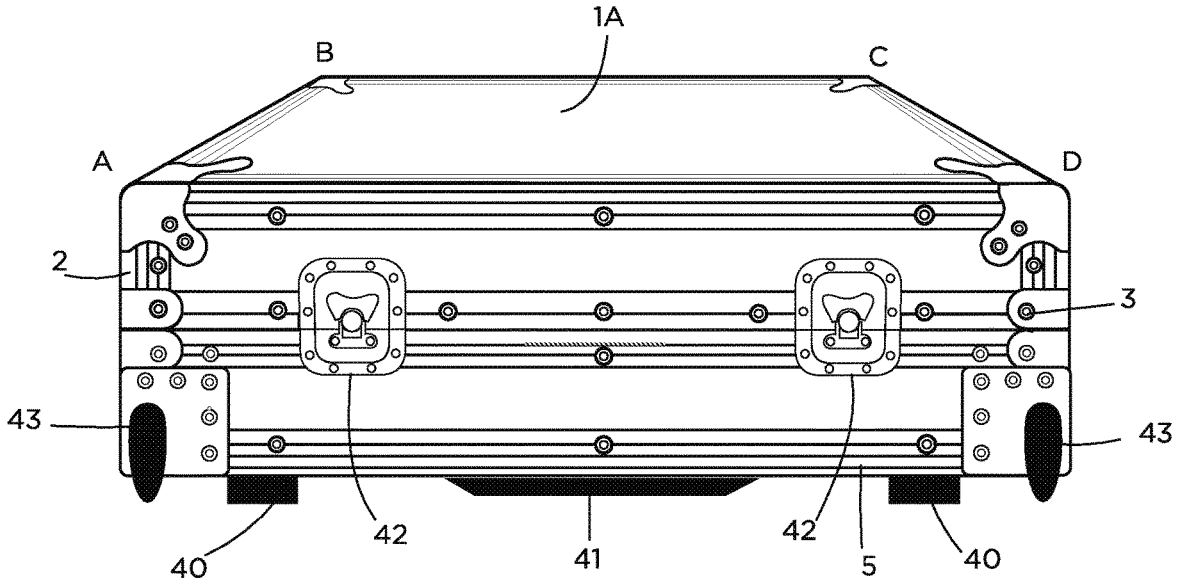
FIG. 1A illustrates a perspective front view of the collapsible silk screen printing apparatus of the disclosure described herein fully enclosed inside a road case.
Figure 1B:
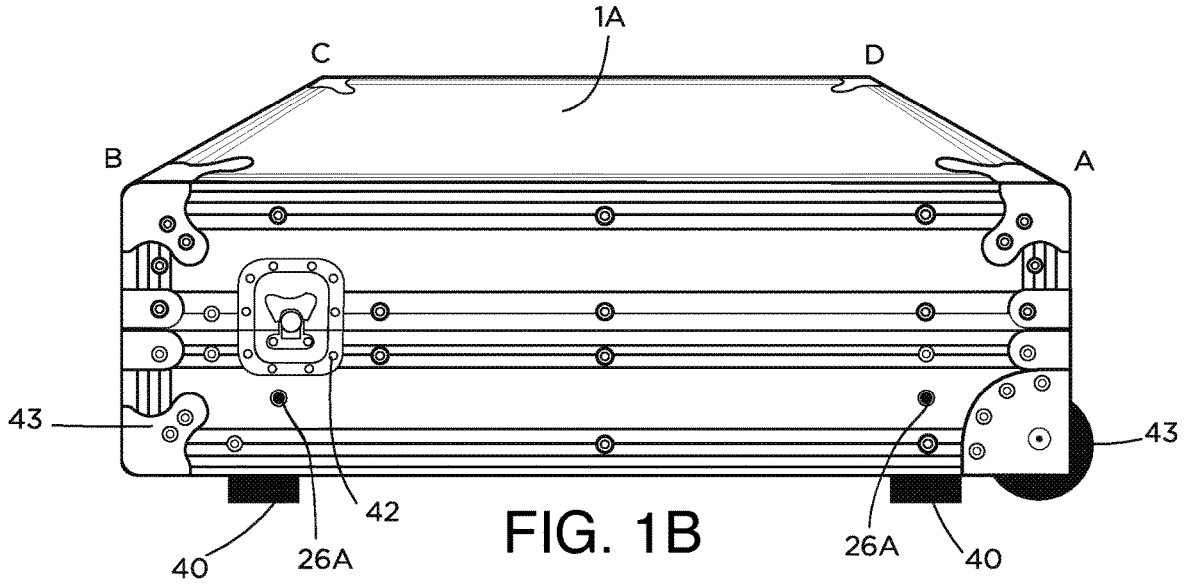
FIG. 1B illustrates a perspective left or right side view for the collapsible screen apparatus of FIG. 1A.

Referring to FIGS. 1A-4, a road casing for the collapsible screen printing apparatus can two halves, namely, a lid 1B and a base 1A. The lid 1B is removed and stored away when the apparatus is in use. The base 1A of the road case is the foundation for the collapsible screen printing apparatus of the disclosure described herein. All necessary parts are fixed or attach to it. The road case is constructed out of high strength carbon fiber modified foam panels. The carbon fiber provides superior resistance to impact and strength enough to be the foundation for the base frame 30 for the apparatus. The carbon fiber panels also allow the apparatus to meet FAA weight restrictions. The two halves of the road case are secured using four metal recessed latches 42. The road case dimensions are 22 inches by 19 inches by 9 inches. Each half is constructed from one 22 inch×19 inch panel and four smaller panels 22 inches long by 4.5 inches wide 1.

Still referring to FIGS. 1A-4, beneath the case foundation are rubber risers 40 fastened at each corner using ¼-20 steel bolts 34 and secured with nylon lock nuts 35 and backed with steel fender washers. 31. Washers are used to prevent damage to the carbon fiber panels while under stress. These risers 40 dampen vibrations during operation and provide friction to prevent the apparatus from sliding during use. A surface-mount retractable carrying handle 41 is attached to the bottom side of the road case. This handle allows for easy transport when used in conjunction with the two corner casters 43 mounted on the base of corners A and D. A surface mounted spring handle 8 is mounted to the side face of the road case. This handle 8 enables the case to be easily lifted off the ground. The base and side walls of the road case are attached using a 90-degree aluminum extrusion. A long extrusion along the base 5 and a shorter extrusion 2 attaches the side walls. The extrusions are attached using ⅜ inch aluminum blind rivets 3 backed with and aluminum washer to give greater pull force on the rivet.

Still referring to FIGS. 1A-4, the perimeter of the top edges of the case are fitted with a beveled extrusion 7 and a tongued extrusion 7A. These extrusions prevent the two halves from slipping off each other when it is closed and latches 42 are engaged. A hard corner. 4 is attached to each outer corner of the road case. These hard corners further protect the road case from damage and add rigidity to its construction. The perimeter tongue and groove extrusions meet at corners and each corner has a metal two hole clamp 6 that is attached using ⅜ inch rivets 3. These corners protect the aluminum extrusions from damage and add rigidity to the overall construction. Further, two aluminum "U" channels 30 are fastened to the inside base of the road case using three ¼-20 steel fasteners 34 and a nylon lock nut 35 tightened to 89 pounds per square inch. The nylon lock nut prevents components from becoming loose due to vibrations caused by transportation or operational use. These "U" channels raise and support the rest of the apparatus's components Referring to FIGS. 2-4, a steel bearing turntable also known as a "Lazy Susan" 10 is fastened to the top side of the "U" channel frame. An important feature of this apparatus is its ability to smoothly rotate continuously in either direction, the Lazy Susan enables this function. The smooth rotating action is a critical function to the proper operation of this apparatus. By enabling the apparatus to rotate the operator can quickly and accurately cycle through various silk screen frames. Further, a round foundation plate 11 is fastened with six 5/16-18 flange bolts 37 spaced evenly around the perimeter of the Lazy Susan. 10. The round aluminum foundation plate has six lobes 11A which point outward. Two 90-degree "L" brackets 12 are fastened to the lobes 11A using ¼-20 steel bolts 38 The left and right "L" brackets are mirrored components. The "L" brackets are spaced exactly 1 inch apart. A 31/32 inch wide by 4.25 inch long Delrin arm 39 fits in the 1 inch space between the two "L" brackets. The Delrin arm is rounded on both ends and has three ¼ inch holes drilled through the sides. Two holes are at each end and the third hole is located ⅓ the length of the arm. The "L" brackets have a ¼ inch hole bored through each vertical wall towards the center of its length. The Delrin arm 39 is placed in the space between the "L" brackets 12. The holes on the Delrin arm and the holes on the "L" brackets are lined up so a ¼ inch steel shoulder bolt 13 can be inserted through the "L" brackets and Delrin arm creating a pivot point for the Delrin arm to rotate around.

Figure 2:
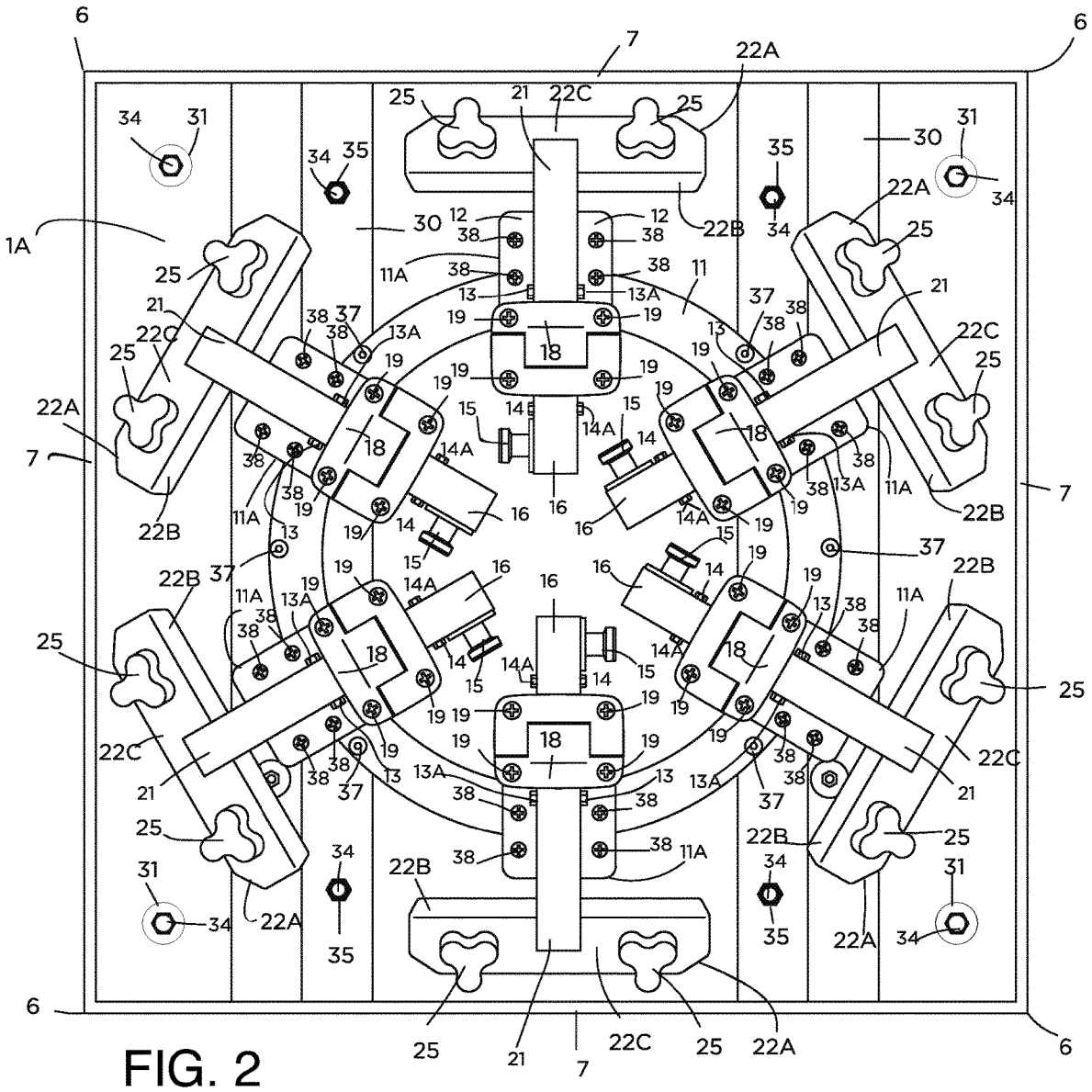
FIG. 2 illustrates a top view of the collapsible screen apparatus of the disclosure described herein shown with all of the arms compressed and ready to be stored for transportation.
Figure 3:
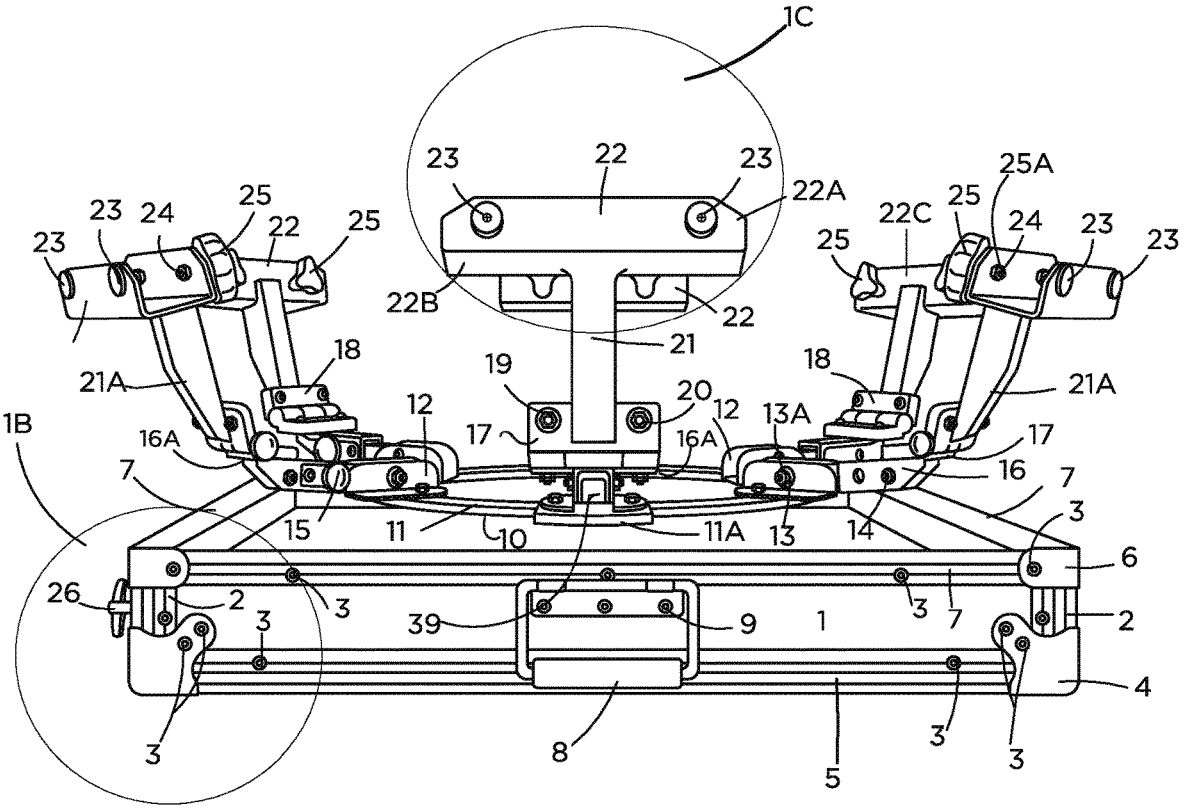
FIG. 3 illustrates a perspective front view with all six arms in an upright position ready to receive a silk screen.
Figure 4:
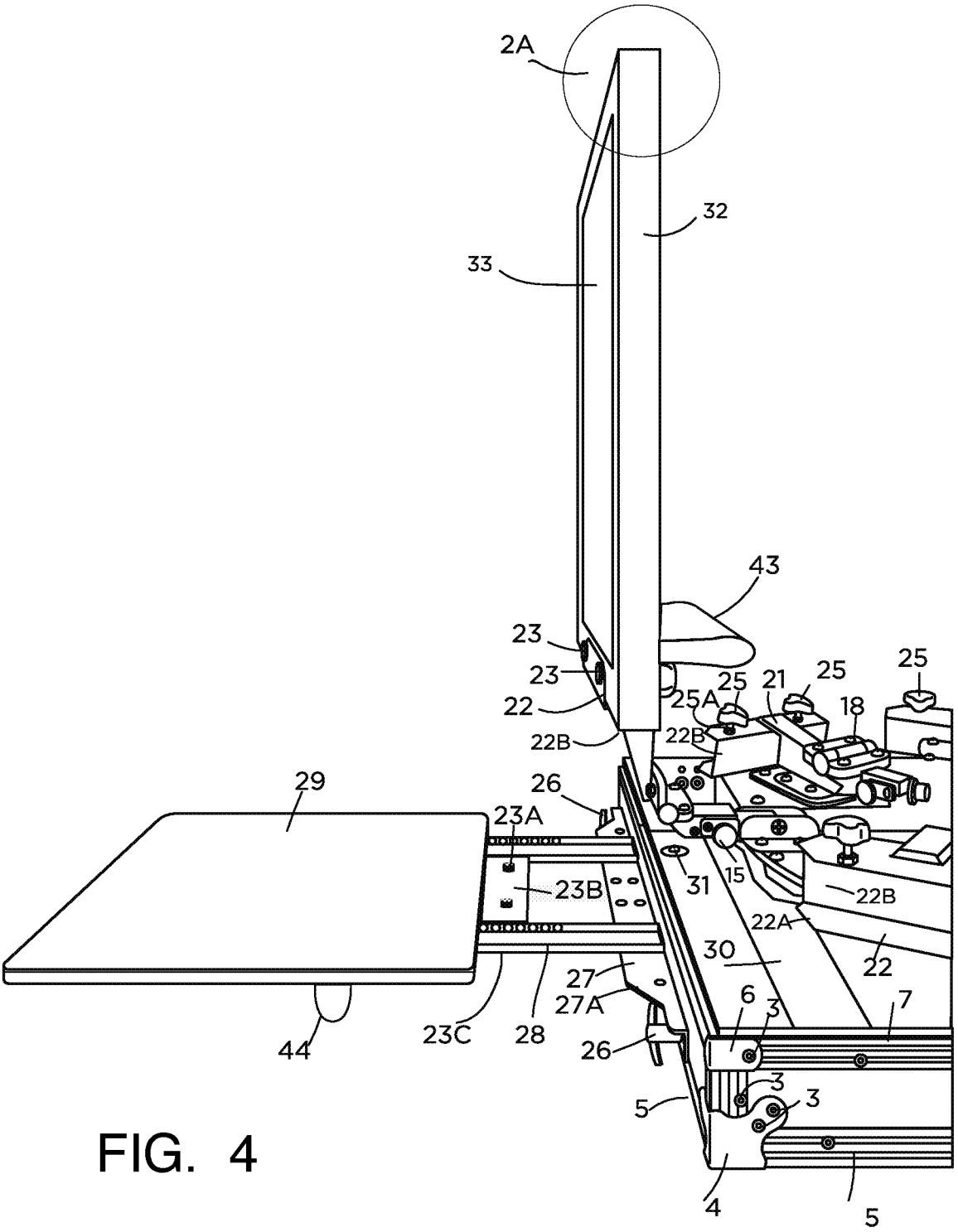
FIG. 4. shows a perspective side view of the collapsible screen pringing apparatus of the disclosure described herein shown with a screen inserted and the printing platens attached to the case body.

Still referring to FIGS. 2-4, a plate mounted retractable plunger 15 is fastened to the right hand side of the rear hinge mount. The plunger passes through the side of the rear hinge mount and into the Delrin arm, This action locks the hinge mount arm in place. When the plunger 15 is retracted the rear hinge mount arm is free to move. A torque hinge 18 with 89 pounds per square inch of operational force is fastened using ¼-20 bolts to the plat side of the hinge mount arm. The other side of the torque hinge 18 is fastened to the printing arm 1C. The printing arm is made of three components, namely, mounting plate 17, a "U" channel arm 21A, and a screen clamp 22. The torque hinge is mounted to the mounting plate. 17 using ¼-20 bolts. The "U" channel arm is 6.5 inches long and has a tapered bottom edge. The length of the arm allows the apparatus to extend beyond the road case (see FIG. 3) and the tapered edge allows the arm to collapse tightly inside the road case (see FIG. 2). The function of the screen clamp 1C is to hold the silk screen 2A firmly during printing. The top side of the screen clamp. 22 has two threaded rivet nuts. 24 one on each outer edge. A rubber turn knob. 25 is threaded through the rivet nut. 24. The knobs 25 apply pressure to the silk screen when turned clockwise. With the screen securely fastened inside the screen clamp the apparatus can be used for print making.

FIG. 4 illustrates the screen fastened in the screen clamps and a sliding platen 29 secured to outside of the road case. Here, the sliding platen 29 is composed of five components, namely, a pair of metal drawer slides 28, a long mounting bracket 27, a platen 29, a pair of "T" handled quick release pins 26 with steel lanyard, and locking collapsible risers 44. The long mounting bracket 27 is secured flat against the exterior of the road case. In addition, the two quick-release pins 26 are inserted through the mounting bracket 27 and are received through two holes 26A located at each side of the road case. The pin receiving holes 26A are composed of a 0.675 inch long 0.275 inch diameter metal sleeve. This the pin receiving sleeve holes 26A allows the quick release of pin 26 to remain secured during printing without applying damaging stress on the carbon fiber road case. The metal drawer slides 28 are secured using ⅛ inch steel blind rivets to the top side of the long mounting bracket 27. The drawer slides allow the platen to collapse for storage and extend when printing. The platen 29 is secured to the two drawer slides 28. The platen is a ⅜ inch aluminum laminated plywood sheet. The aluminum laminate prevents the plywood from being dented and maintains a smooth surface which is crucial for successful printing.

Still referring to FIG. 4, once the printing arm is extended and brought down to the platen surface a two part magnetic registration apparatus 23, 23A, is used to engage the printing arm with the platen preventing any unwanted side to side or up and down movement. This registration technology is a unique design specific to the collapsible silk screen apparatus. Two neodymium magnets 23 with a pull force of 12.3 lbs are mounted to the underside of the screen mount 22 using ⅜" machine screws and high strength epoxy (to prevent the magnets from cracking under stress). A flat aluminum plate bracket 23B is secured to the underside of the rail slides 28 and runs parallel to the printing arm. Two neodymium magnets 23A with a pull force of 12.3 lbs are mounted to the top of the aluminum plate bracket 23B using ⅜" machine screws. When the two sets of magnets interact a pull force of roughly 49.2 lbs securely locks the screen clamp 22 to the printing platen 29 enabling the press to achieve consistent and accurate prints time and time again. To release the magnets the operator lifts upward on the silk screen. To engage the magnets the operator pulls down on the silk screen.

The invention claimed is:

1. A portable screen printing apparatus, comprising:

a housing having an interior region, a base, and a removable lid, such that the housing has an open and closed configuration via the lid;

the housing having a pair of first securement members on its outer surface;

a rotatable platform secured to the base of the housing and fully enclosed by the lid within the interior region of the housing in the closed configuration;

a plurality of folding arms secured to the rotatable platform such that the folding arms have a folded and unfolded configuration, wherein the folding arms in the folded configuration are fully enclosed by the lid within the interior region of the housing in the closed configuration;

each of the folding arms further comprising a first arm member and a second arm member, wherein the first arm member is coupled to the rotatable platform and the second arm member pivots relative to the first arm member;

a first bracket secured to a distal end of the second arm member, wherein the bracket is configure to secure a silk screen;

a second bracket coupled to the outer surface of the housing, wherein the second bracket is secured to the housing via a pair of second securement members coupled to the pair of first securement members;

a pair of slides secured to the second bracket and extending therefrom; and a platen secured to the pair of slides, wherein the platen is configured to slide relative to the housing.

2. The portable screen printing apparatus of claim 1, wherein the rotatable platform is comprised of a turntable.

3. The portable screen printing apparatus of claim 1, further comprising a hinge coupled to the first arm member and the second arm member.

4. The portable screen printing apparatus of claim 1, wherein the first bracket is further comprised of a U-shaped configuration.

5. The portable screen printing apparatus of claim 1, wherein the second bracket is further secured to the rotatable platform.

6. The portable screen printing apparatus of claim 5, wherein the first arm member is configured to pivot via the second bracket.

7. The portable screen printing apparatus of claim 6, wherein the first arm member folds on top of the second arm member.

8. A portable screen printing apparatus, comprising:

a casing having an interior region, a first half, and a second half, wherein the second half covers the first half, such that the casing comprises an open and closed configuration;

the casing having a pair of first securement members on its outer surface;

a turntable secured to the first half of the casing and fully enclosed by the second half within the interior region of the casing in the closed configuration;

a plurality of articulating arms secured to the turntable such that the articulating arms have a folded and unfolded configuration, wherein the articulating arms in the folded configuration are fully enclosed by the second half within the interior region of the casing in the closed configuration;

each of the articulating arms further comprising a first arm member and a second arm member, wherein the first arm member is coupled to the turntable and the second arm member pivots relative to the first arm member;

a first bracket secured to a distal end of the second arm member, wherein the bracket is configure to receive a silk screen therein;

the first bracket comprising a first magnet;

a second bracket coupled to the outer surface of the casing, wherein the second bracket is secured to the casing via a pair of second securement members coupled to the pair of first securement members;

a pair of slides secured to the second bracket and extending therefrom;

a third bracket or plate coupled to the pair of slides, wherein the third bracket comprises a second magnet, wherein the second magnet and first magnet are configured to engage each other; and a platen secured to the pair of slides, wherein the platen is configured to slide relative to the housing.

9. The portable screen printing apparatus of claim 8, further comprising a hinge coupled to the first arm member and the second arm member.

10. The portable screen printing apparatus of claim 8, wherein the first bracket is further comprised of a U-shaped configuration.

11. The portable screen printing apparatus of claim 8, wherein the second bracket is further secured to the turntable.

12. The portable screen printing apparatus of claim 11, wherein the first arm member is configured to pivot via the second bracket.

13. The portable screen printing apparatus of claim 12, wherein the first arm member folds on top of the second arm member.

14. A portable screen printing apparatus, comprising:

a casing having an interior region, a compartment, and a removable lid that couples to and uncouples from the compartment, such that the lid covers the compartment in a closed configuration of the casing;

a turntable disposed within the interior region of the casing;

a plurality of articulating arms secured to the turntable, wherein the articulating arms are at least partially enclosed within the interior region of the housing;

each of the articulating arms further comprising a first arm member and a second arm member, wherein the first arm member is coupled to the turntable and pivots relative to the turntable, and the second arm member is coupled to the first arm member and pivots relative to the first arm member;

a first bracket secured to a distal end of the second arm member;

the first bracket having a first magnetic member;

a sliding platen secured to a side of the casing; and a second magnetic member disposed adjacent to the sliding platen, wherein the first magnetic member is configured to engage the second magnetic member.

15. The portable screen printing apparatus of claim 14, wherein the compartment and lid of the casing each comprise an outer shell.

16. The portable screen printing apparatus of claim 14, wherein the casing further comprises a pair casters secured thereto.

* * * * *